US008640506B1

(12) United States Patent
Grear et al.

(10) Patent No.: US 8,640,506 B1
(45) Date of Patent: Feb. 4, 2014

(54) LAUNDRY BAG AND KIT FOR WASHING SHOES

(75) Inventors: Stephen C. Grear, Tucson, AZ (US); Carmadel T. Zaborsky, Tucson, AZ (US)

(73) Assignee: Stephen C. Grear, Tucson, AZ (US)

( * ) Notice: Subject to any disclaimer, the term of this patent is extended or adjusted under 35 U.S.C. 154(b) by 699 days.

(21) Appl. No.: 12/897,508

(22) Filed: Oct. 4, 2010

(51) Int. Cl.
*B65D 30/22* (2006.01)

(52) U.S. Cl.
USPC ..... 68/235 R; 383/117

(58) Field of Classification Search
USPC ..... 68/235 R; 383/61.4, 117
See application file for complete search history.

(56) References Cited

U.S. PATENT DOCUMENTS

| | | | | | |
|---|---|---|---|---|---|
| 618,943 | A * | 2/1899 | Kahnweiler | 401/201 |
| 2,080,252 | A | 5/1937 | Cook | 150/1 |
| 2,437,149 | A | 3/1948 | Baxter | 150/1 |
| 2,497,325 | A | 2/1950 | Scherba | 150/52 |
| 4,261,071 | A | 4/1981 | Forte | 12/115.6 |
| 4,388,739 | A | 6/1983 | Martinon et al. | 8/150 |
| 4,566,144 | A * | 1/1986 | Arneson | 15/3 |
| 4,691,400 | A * | 9/1987 | Arneson | 15/3 |
| 4,800,605 | A * | 1/1989 | Arneson | 15/3 |
| 5,230,115 | A | 7/1993 | Hollister et al. | 12/128 B |
| 5,367,735 | A * | 11/1994 | Mosier et al. | 12/128 B |
| 5,596,785 | A * | 1/1997 | Park | 15/114 |
| 6,398,410 | B1 | 6/2002 | Guerra | 383/24 |
| 6,726,362 | B1 * | 4/2004 | Frisch et al. | 383/103 |
| 6,785,924 | B1 | 9/2004 | Rogers et al. | 8/159 |
| 7,056,023 | B2 * | 6/2006 | Heidel | 383/117 |
| 7,185,801 | B2 | 3/2007 | Session, Sr. | 232/1 B |
| 7,959,356 | B2 * | 6/2011 | Sommers | 383/16 |
| 2005/0084182 | A1 * | 4/2005 | Penson | 383/38 |
| 2005/0249439 | A1 * | 11/2005 | Penson | 383/38 |
| 2008/0226204 | A1 * | 9/2008 | Sabounjian et al. | 383/74 |

FOREIGN PATENT DOCUMENTS

| | | | |
|---|---|---|---|
| JP | 2008068043 | A * | 3/2008 |

* cited by examiner

*Primary Examiner* — Joseph L Perrin
(74) *Attorney, Agent, or Firm* — Hayes Soloway P.C.

(57) ABSTRACT

A laundry bag for washing shoes comprises a first closing member disposed about a portion of the bag between the open end and a closed end, and a second closing member disposed about an open end of the bag. The bag is of a size such that a first pair of shoes may be secured in a first compartment formed between the closed end of the bag and the first closing member, and a second pair of shoes may be secured in a second compartment formed between the first compartment and the open end of the bag. A kit for washing shoes comprises such a laundry bag and at least one pair of waterproof shoe trees.

17 Claims, 2 Drawing Sheets

LAUNDRY BAG AND KIT FOR WASHING SHOES

FIELD OF THE INVENTION

The present invention relates to a laundry bag and a kit for washing shoes. The invention has particular utility for securing shoes in place during a wash cycle, thereby reducing damage caused to the shoes by abrasion. Furthermore, the invention has utility for preserving the shape of shoes during and after a wash cycle, thereby reducing deformation of the shoes as well as damage caused to the shoes by such deformation. The invention will be described in connection with such utility, although other utilities are contemplated.

BACKGROUND OF THE INVENTION

Shoes, particularly sneakers or athletic shoes, often become soiled, odorous and in general need of a thorough washing after some amount of use. One problem associated with washing shoes in a conventional automatic washing machine is that the shoes often becoming scuffed, scraped and/or generally worn down due to mechanical abrasion caused by contact with the washing machine agitator, the walls of the washing machine, other objects in the wash load, as well as contact between the shoes being washed. Sneakers also may experience undesirable fiber pilling and other fiber damage resulting, to some extent, from abrasion during the wash cycle. Additionally, shoes often become deformed during and after the washing process, losing their desired shape properties. As a result of shape deformation during the washing process, creases and cracks develop in the shoe and other general wear and tear results.

U.S. Pat. No. 6,785,924 discloses a method of orienting shoes in a washing machine and devices for aligning shoes in a washing machine that includes a containment bag having one or more separate "pockets" for holding up to four shoes to be washed. However, the "pockets" are permanently defined compartments that are formed, for example, by stitching. Thus, if the size of the shoe does not match the size of the pocket, the shoes will not be snuggly fit within the pocket. Moreover, each pocket only holds one shoe.

U.S. Pat. No. 4,388,739 discloses a washing bag for curtains and drapes that has a net fabric and is formed at its mouth with two spaced-apart ties adapted to define two compartments, a large compartment for containing the curtains or drapes, and a small compartment in which the suspension hooks, rings or other attachment of the curtains or drapes can be confined. However, the patented bag is not designed to be used for washing footwear, and if it were to be so used, the shoes would scuff and scrape one another.

Thus, there remains a need in the field for a laundry bag for washing shoes that can securely hold shoes, for washing, while preventing damage due to abrasion. There is a further need in the field for such a laundry bag that can accommodate both adult sized shoes and children sized shoes. Moreover, there remains a need in the field for a kit that includes such a laundry bag and at least one pair of waterproof shoe trees so that the shoe shape may be preserved during and after a washing process and damage due to shape deformation may be prevented.

SUMMARY OF THE INVENTION

The present disclosure is directed to a laundry bag and kit for washing shoes that overcomes the aforesaid and other disadvantages of the prior art. More particularly, the present disclosure provides a laundry bag for washing shoes that has two closing members that can be closed to snug together different size pairs of shoes, and prevent the shoes from rubbing against one another. Furthermore, the present disclosure provides a kit for washing shoes that includes such a laundry bag and at least one pair of washable shoe trees for preserving the shape of the shoes during the washing process In one aspect, the present disclosure provides a laundry bag for washing shoes that includes a first closing member disposed about a portion of the bag between the open end and a closed end, and a second closing member disposed about an open end of the bag. The bag is of a size such that a pair of adult-sized shoes may be secured and snugged down by the first closing member, and the open end of the bag is then closed by the second closing member.

The laundry bag may be composed of a machine-washable mesh material.

In a further aspect, the first closing member is disposed substantially equidistant from the open end and the closed end, such that the first and second compartments are of a size to accommodate two pairs of childrens' shoes.

The first and second closing members may be drawstrings, and the drawstrings may be provided with cord locks for keeping the drawstrings taut after they have been tightened.

In yet another aspect provided by the present disclosure, a divider may be disposed in a plane of symmetry between the open end and the closed end of the bag, the divider dividing the bag into two symmetrical halves.

In another aspect, the present disclosure provides a kit for washing shoes that includes a laundry bag having a first closing member disposed about a portion of the bag between the open end and a closed end, and a second closing member disposed about an open end of the bag, and at least one pair of waterproof shoe trees for preserving the shape of shoes during a washing process. The bag is of a size such that a pair of adult-sized shoes may be secured and snugged down by the first closing member, and the open end of the bag is then closed by the second closing member. The kit may further include a scrub brush for pre-treating heavily soiled portions of the shoes.

The laundry bag provided in the kit may include any of the features described above in reference to the laundry bag for washing shoes.

The waterproof shoe trees may consist of a toe piece, but preferably includes a toe piece, a heel piece and a center piece. The center piece may allow for compression between the heel piece and the toe piece. The waterproof shoe trees may be composed of waterproof plastic.

In a further aspect, the laundry bag, shoe trees and a pair of shoes may be packaged and sold as a unit, or the laundry bag and shoe trees given as a premium with a pair of shoes. Furthermore, a scrub brush may be included in the package with the laundry bag, shoe trees and pair of shoes.

Accordingly, an advantage of the present disclosure is to provide a laundry bag for washing shoes that can securely hold the shoes, thereby preventing and/or reducing damage due to scuffing and scraping. Furthermore, an advantage of the present disclosure is to provide a laundry bag that can accommodate two pairs of shoes, as well as a laundry bag that can accommodate a pair of adult sized shoes in one compartment and a pair of children sized shoes in the other compartment, or two pairs of childrens' shoes. Additionally, an advantage of the present disclosure is to provide a kit that includes such a laundry bag for washing shoes and at least one pair of waterproof shoe trees so that the shoe shape may be preserved during and after a washing process and damage due to shape deformation may be prevented.

The features, functions and advantages that have been discussed can be achieved independently in various embodiments of the present disclosure or may be combined in yet other embodiments, further details of which can be seen with reference to the following descriptions and drawings.

BRIEF DESCRIPTION OF THE DRAWINGS

Further features and advantages of the invention will be seen from the following detailed description, taken in conjunction with the accompanying drawings, wherein like numerals depict like parts, and wherein.

DETAILED DESCRIPTION

In the following description, reference is made to the accompanying drawings, which form a part hereof, and in which is shown, by way of illustration, various embodiments of the present disclosure. It is understood that other embodiments may be utilized and changes may be made without departing from the scope of the present disclosure.

Figure 1:
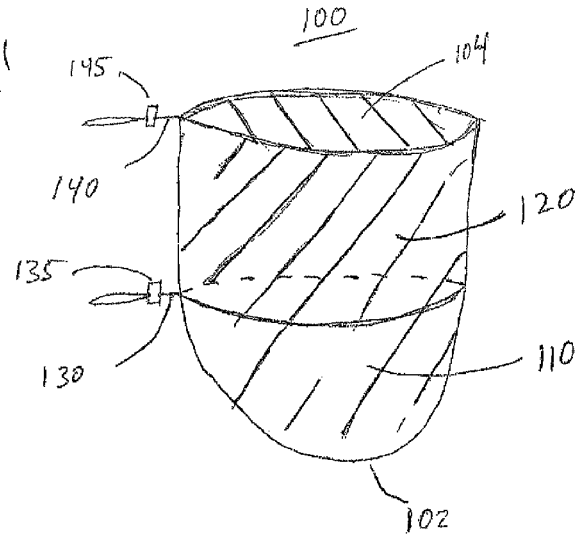
FIG. 1 illustrates a laundry bag for washing shoes in accordance with an embodiment of the present disclosure.

FIG. 1 illustrates a primary example of a laundry bag for washing shoes provided by this disclosure. The bag 100 is made of a flexible material that protects the shoes when being washed in a washing machine. The bag 100 serves as a barrier between shoes placed inside the bag and other objects external to the bag, such as the agitator in a top load washing machine and/or other laundry items in the same wash load, and thus reduces or eliminates damage to the shoes caused by abrasion. Furthermore, the bag 100 is a mesh bag composed of machine-washable materials, such as nylon, cotton, polyester and the like. The openings in the mesh material allow for water and detergent, as well as soil and other shoe contaminants, to pass through the bag during the washing process.

The bag 100 has a closed end 102 and an open end 104. The bag may be of any suitable shape such that a pair of shoes may be secured in each compartment 110, 120 in the bag 100. Preferably, the bag is sized such that one or two pairs of shoes may be secured sole-to-sole when the compartments are closed.

The bag 100 is provided with two closing members. The closing members may be any suitable closing members that can be drawn down, e.g. to define two separate compartments 110, 120 in the bag. The closing members may be, but are not limited to, snap fasteners, straps, hook and loop fasteners, drawstrings, or any combination thereof. For example, the upper closing member may be a drawstring while the lower closing member may be composed of one or more snaps.

In a preferred embodiment, the closing members are both drawstrings 130, 140 which, when tightened, define two separate compartments 110, 120. The upper drawstring 140 is provided about the open end 104 of the bag 100. The lower drawstring 130 is provided in between the open end 104 and closed end 102 and may be provided in the center of the bag 100 substantially equidistant from each end. With the lower drawstring 130 provided in the center of the bag, the two compartments 110, 120 have substantially the same size and may accommodate, for example, two pairs of children's shoes. The placement of the lower drawstring 130 determines the size of the compartments 110, 120, and therefore the lower drawstring 130 may be provided in different positions depending on the type and size of shoes which the bag 100 will contain. The lower drawstring 130 also may be used to snuggly hold a single pair of shoes, sole-to-sole, to prevent the shoes from scuffing one another.

The drawstrings 130, 140 may be held taut by tying a knot in the drawstrings, or with a sliding device that may be tightened, such as a cord fastener or cord lock 135, 145. In the example illustrated in FIG. 1, cord locks 135, 145 are provided on drawstrings 130, 140 which attach to the drawstrings and keep the drawstrings taut after they have been tightened. The drawstrings may be made of nylon, cotton, polyester, or any other suitable material.

Figure 2A:
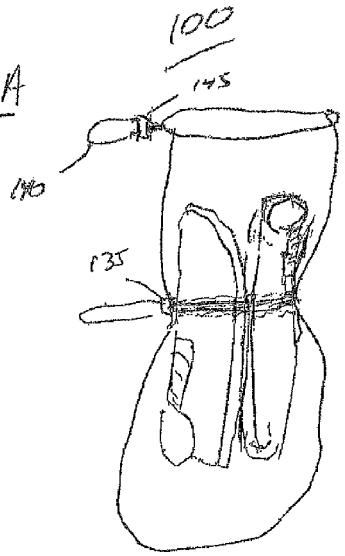
FIGS. 2A and 2B illustrate a laundry bag for washing one pair or two pairs of shoes in two loaded conditions in accordance with the present disclosure.
Figure 2B:
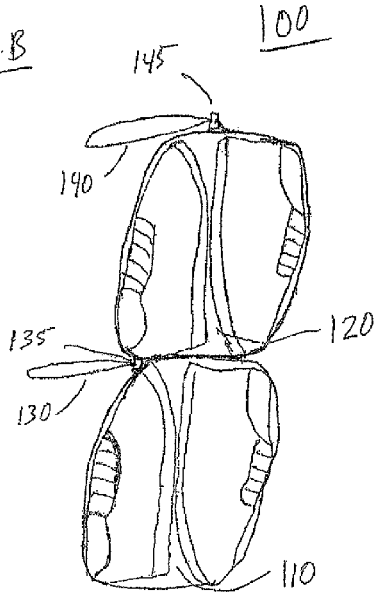

FIG. 2A illustrates a single pair and FIG. 2B two pairs of shoes loaded into the laundry bag provided by this disclosure. As shown in FIG. 2A, a single pair of shoes is loaded into the bag 100, and positioned sole-to-sole. The lower drawstring 130 is then drawn tight and locked taut by cord lock 135. The upper drawstring 140 is then pulled tight and locked taut by cord lock 145. Alternatively, as shown in FIG. 2B, the first pair of shoes is placed in the bag 100 and the lower drawstring 130 is drawn tight and the cord lock 135 is positioned such that the drawstring 130 is kept taut. In this way, the first pair of shoes is enclosed and tightly secured within the first compartment 110. Then, a second pair of shoes may be placed in the bag 100, where they come to rest on the top of the first compartment 110 which is filled by the first pair of shoes. The upper drawstring 140 is then drawn tight and the cord lock 145 is positioned such that the drawstring 140 is kept taut. The second pair of shoes is thus enclosed and tightly secured within the second compartment 120. The first and second pairs of shoes are separated from each other by the bag material drawn in by the lower drawstring 130. The shoes may thus be washed, enclosed in their separate compartments and protected from scuffing or abrasion caused by the washing machine agitator, other objects external to the bag 100 and from the other shoes in the bag.

As further illustrated by FIGS. 2A and 2B, the shoes preferably are placed sole-to-sole and when the drawstrings are drawn taut, friction between the soles of the shoes further holds the shoes in place, preventing damage from scuffing and abrasion between the shoes.

Figure 3:
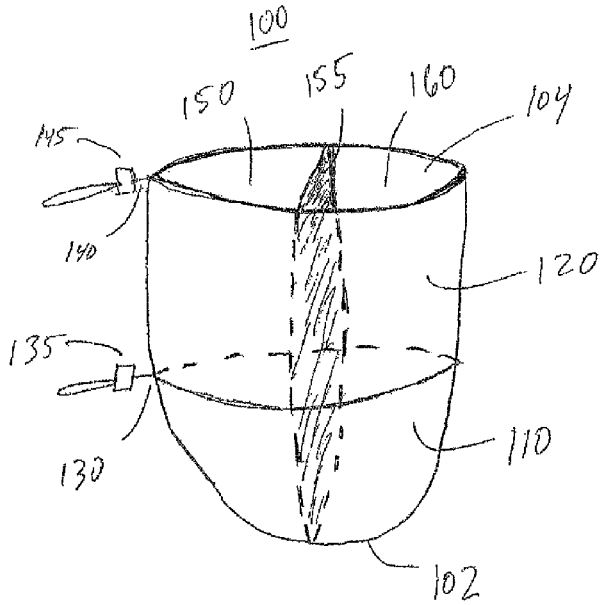
FIG. 3 illustrates a laundry bag for washing shoes, wherein the laundry bag has a divider in accordance with a further aspect provided by the present disclosure.

FIG. 3 illustrates a further aspect provided by this disclosure in which the bag 100 is separated into two symmetrical halves 150, 160 by a divider 155 disposed in a plane of symmetry between the open end and the closed end of the bag. The divider 155 may be of the same material as the bag (i.e. mesh nylon, polyester, cotton, etc.) or it may be composed of any other mesh or non-mesh washable material. The divider 155 separates shoes of the same pair in both the lower compartment 110 and the upper compartment 120, thereby further preventing damage from scuffing and abrasion between the shoes.

Figure 4:
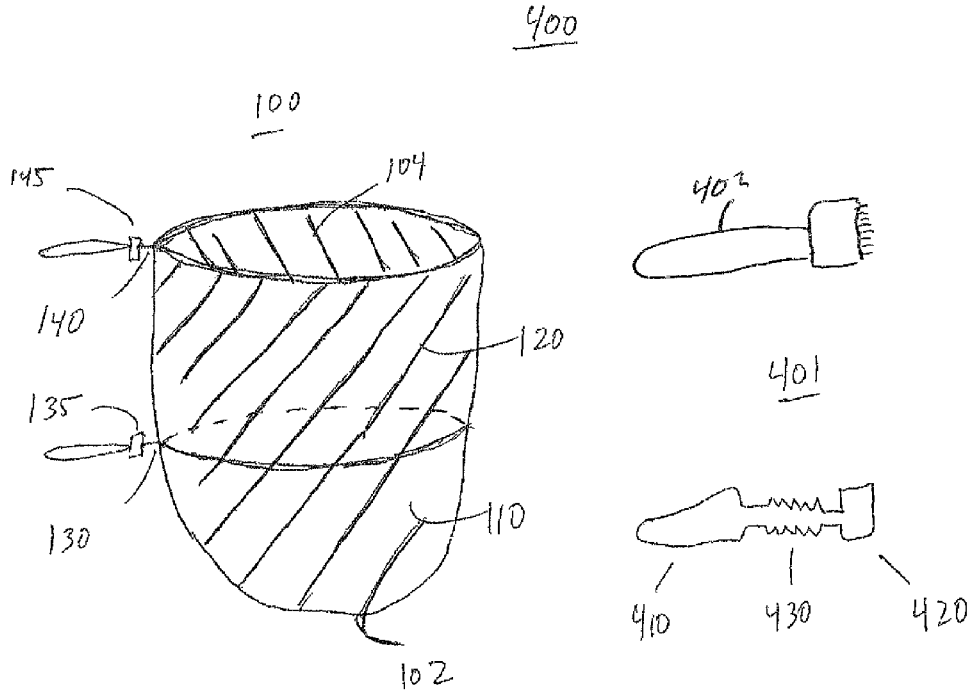
FIG. 4 illustrates a kit for washing shoes in accordance with another aspect of the present disclosure.

A kit 400 for washing shoes is provided in a further aspect of the present disclosure. Referring to FIG. 4, the kit 400 includes a laundry bag 100 for washing shoes and a pair of waterproof shoe trees 401. The kit 400 may include two pairs of shoe trees, one pair for each pair of shoes to be washed with the kit. The laundry bag 100 may be any of the types of bags described above, and may include a vertical divider as shown in FIG. 3.

The shoe tree 401 consists of a toe piece 410, a heel piece 420 and a center piece 430. The shoe tree 401 is made of a rigid or semi-rigid washable material, such as waterproof plastic or foam. The center piece 430 allows for compression between the heel piece 420 and toe piece 410 and may be made of a springy or compressible material. For example, the toe piece 410 and heel piece 420 may be composed of a rigid plastic and connected by the heel piece 420 which may be formed of semi-rigid and compressible foam. As an alternative example, the center piece 430 may be formed of a plastic configured as a compressible bellows-type structure. In another aspect, the shoe tree 401 consists solely of a toe piece. The toe piece may further include a handle for inserting the toe piece into the shoe, and for removing the toe piece from the shoe.

The waterproof shoe tree 401 provides structure within the shoe during the washing process, and thus preserves the shape of the shoe during and after the wash, and while the shoes dry. In preserving the shape of the shoe, the shoe tree prevents the development of cracks, creases and other undesirable wear and tear that may otherwise result from the washing process.

A scrub brush 402 may further be included with the kit 400. The scrub brush may be any brush suitable for scrubbing shoes to pre-treat heavily soiled portions of the shoes.

In a further aspect, the kit is packaged with a pair of shoes, preferably sneakers or athletic shoes. In such case the shoe trees 401 may be sized to match the size of the shoes, and the compartments 110, 120 of the bag 100 may be sized to tightly secure the shoes when the compartments are closed. Alternatively, the shoe trees and laundry bag may be of universal size. As will be appreciated, the kit may be packaged and sold with the shoes, or given away as a sales premium with the shoes, e.g. to promote the sale of the shoes.

As can be seen from the foregoing description, the present invention provides a unique laundry bag and kit for washing shoes that permits one or two pairs of shoes to be washed in the same washable bag, while tightly securing the shoes and preventing damage caused by scuffing and abrasion from the washing machine agitator, other objects external to the bag and the shoes themselves.

Various changes may be made in the invention without departing from the spirit and the scope thereof. It should be emphasized that the above-described embodiments of the present laundry bag and kit for washing shoes are merely possible examples of implementations and are merely set forth for a clear understanding of the principles of the invention. Many different embodiments of the laundry bag and kit for washing shoes described herein may be designed and/or fabricated without departing from the spirit and scope of the invention. All these and other such modifications and variations are intended to be included herein within the scope of this disclosure and protected by the following claims. Therefore the scope of the invention is not intended to be limited except as indicated in the appended claims.

What is claimed is:

1. A kit for washing shoes comprising:

(A) a laundry bag comprising:

a first closing member, disposed about a portion of the bag between an open end and a closed end; and a second closing member, disposed adjacent the open end of the bag, wherein the first closing member is disposed substantially equidistant from the open end and the closed end of the laundry bag such that a pair of shoes may be snuggly held in the bag by the first closing member, and prevented from scuffing one another, and the bag closed by the second closing member; and (B) at least one pair of waterproof shoe trees for preserving the shape of shoes during a washing and drying process.

2. The kit of claim 1, wherein the laundry bag is composed of a machine-washable mesh material.

3. The kit of claim 1, wherein the first closing member is disposed substantially equidistant from the open end and the closed end of the laundry bag, such that the first and second compartments are of a size to accommodate two pairs of shoes.

4. The kit of claim 1, wherein the first closing member is disposed about a portion of the bag offset from a plane equidistant from the open end and the closed end.

5. The kit of claim 1, wherein the first and second closing members are drawstrings.

6. The kit of claim 5, wherein the drawstrings are provided with cord locks for keeping the drawstrings taut after they have been tightened.

7. The kit of claim 1, wherein the laundry bag further includes a divider disposed in a plane of symmetry between the open end and the closed end of the bag, said divider dividing the bag into two symmetrical halves.

8. The kit of claim 1, wherein the at least one pair of waterproof shoe trees each comprise a toe piece.

9. The kit of claim 8, wherein the at least one pair of waterproof shoe trees each further comprise a heel piece and a center piece.

10. The kit of claim 9, wherein the center piece allows for compression between the heel piece and the toe piece.

11. The kit of claim 1, wherein the at least one pair of waterproof shoe trees are composed of waterproof plastic.

12. The kit of claim 1, further comprising a scrub brush.

13. The kit of claim 1, packaged with a pair of shoes.

14. The kit of claim 13, wherein the pair of shoes comprise sneakers.

15. A method for promoting the sale of shoes, comprising packaging with the sale of the shoes a laundry bag as claimed in claim 1.

16. The method of claim 15, further comprising packaging at least one pair of shoe trees with the sale of the shoes.

17. The method of claim 15, further comprising packaging a scrub brush with the sale of the shoes.

* * * * *